US005678512A

United States Patent [19]

Colton

[11] Patent Number: 5,678,512

[45] Date of Patent: Oct. 21, 1997

[54] COOLING AIR FLOW SYSTEM FOR A SELF CONTAINED MOTOR GENERATOR SET

[75] Inventor: Mark W. Colton, Clay, N.Y.

[73] Assignee: Carrier Corporation, Syracuse, N.Y.

[21] Appl. No.: 757,602

[22] Filed: Nov. 29, 1996

[51] Int. Cl.[6] ..... F02B 63/00

[52] U.S. Cl. ..... 123/2; 62/239; 62/323.1

[58] Field of Search ..... 123/2; 62/239, 62/323.1; 322/100; 248/647

[56] References Cited

U.S. PATENT DOCUMENTS 5,433,175 7/1995 Hughes et al. ..... 123/2

*Primary Examiner*—Noah P. Kamen

[57] ABSTRACT

A self contained motor generator set including an integral fuel tank, which defines a space which supports and partially contains the motor, generator and related components. The exhaust pipe of the motor passes through an opening in the fuel tank. The fuel tank and an outer cover cooperate with the radiator and fan of the motor cooling system to define a cooling air flow path. Ambient air for cooling the motor is drawn through openings in the front of the cover, through the radiator and into the space containing the components to pressurize the space. Air exits from the space through the exhaust pipe opening in the fuel tank and through outlet openings in the cover.

6 Claims, 9 Drawing Sheets

COOLING AIR FLOW SYSTEM FOR A SELF CONTAINED MOTOR GENERATOR SET

BACKGROUND OF THE INVENTION

The present invention relates to self contained engine driven electrical generators. More particularly, the invention relates to a cooling air flow system for self a contained engine driven electrical generator of the type used in connection with a refrigerated transport container.

An increasingly popular way of transporting goods makes use of removable cargo carrying containers, commonly referred to as "intermodal" containers, which are adapted for transport over both land and water. Such containers are designed for transport by truck or rail to a freight terminal or ship loading dock, where they may be transferred to a ship for overseas delivery.

Many of such containers are provided with refrigeration units which allow them to transport perishable goods therein. The refrigeration units attached to such containers include an electric motor for driving a refrigerant compressor forming a part of the unit. As a result, they require a source of electrical power for operation. When located at a freight terminal, a refrigerated container is provided with electrical power through a connection to a conventional source of electrical power. When located on a ship, a refrigerated container receives electrical power from the ship's electrical system. When being transported by road, rail or when no other power source is available, a self contained temporary power source which includes a motor generator set, may be mounted directly to the refrigerated container.

Since the generator set is a self-contained source of auxiliary power, it is necessary that an integral part thereof be a fuel tank for the motor, which is typically a diesel engine. Many generator sets are required to have the capability to provide uninterrupted service for an extended length of time. For example, for transcontinental rail shipping, it is desirable to have a generator set which is capable of operating for more than 130 hours without requiring refueling. Such extended use capabilities also will increase the reliability of the system and decrease operating costs. Accordingly, it is desirable to provide a high capacity integral fuel tank for such a generator set.

It should be appreciated that space is extremely limited in the design of such a generator set. Such space limitations are a result of the environment in which they are used wherein there are limitations on components extending beyond a prescribed envelope universally defined by the width of the containers on which they are used. Also, because such generator sets are quite often mounted on containers being towed by tractor trailers, size limitations are dictated by the necessity of providing adequate clearance between the generator and the tractor unit. Further space limitations are dictated by the requirement that the generator set not extend vertically above the top of the container on which it is mounted nor should it extend downward such that it would interfere with the condenser discharge and the operating controls of the refrigeration unit.

One approach to achieving a high capacity fuel tank has been to provide a substantially U-shaped fuel tank having a lower section, which underlies and supports the motor generator and other components of the generator set and which comprises upstanding sections on one or both sides of the generator set. Units are known which have two short towers or one full height tower and one short tower.

The height of such towers in prior art units has been limited by problems regarding engine cooling, exhaust system locations and other space restraints dictated by the generator set and its peripherals.

A U.S. patent application entitled "Removable "Powertray" For A Self Contained Motor Generator Set", assigned to the assignee of the present invention, was filed on Dec. 26, 1995, as U.S. Ser. No. 08/578,263. This application describes a motor generator set wherein the power generation section including the engine, electrical generator, radiator, and all other major components are included as integral parts of the power generation section.

Another U.S. patent application entitled "Fuel Tank Having Pass Through Conduits", also assigned to the assignee of the present invention, was filed on Dec. 26, 1995, as U.S. Ser. No. 08/578,400. The '400 patent application discloses a fuel tank design for a self contained motor generator set wherein passageways are formed in sections of the fuel tank, which allow passage of the motor generator assemblies exhaust pipe and power cables therethrough.

SUMMARY OF THE INVENTION

The present invention relates to an engine cooling air flow system for a self contained generator set of the type adapted to be mounted on a transport container, which has a refrigeration unit mounted on one end thereof. The generator set is adapted to provide electrical power for the refrigeration unit. The fuel tank of the generator set includes a base section defining a substantially horizontal structural support surface and two vertically extending sections spaced from one another. The horizontal support surface and the two vertically extending section cooperate to define a substantially U-shaped structure having a space therebetween. The space has a substantially open, top, front and back. A power generation section is mounted in the space. The power generation section includes an engine having an exhaust pipe and a radiator assembly for cooling the engine. The radiator assembly includes a heat exchanger and a fan. The fan is adapted to draw ambient cooling air from outside the space and direct such air across the heat exchanger and into the space. One of the vertically extending sections of the fuel tank has a passageway extending therethrough. The exhaust pipe from the engine extends through the passageway in the fuel tank. A cover substantially encloses the front and top of the space. The cover includes a front section and a top section, both of which have air flow openings formed therein. Some of the openings in the cover sections serve as inlet openings for the flow of ambient air to the radiator fan, and, other of the openings serve as outlets for air which has been directed into the space. The passageway through which the exhaust pipe passes also serves as an outlet for air directed into space. Means are provided for preventing the air flow through the back of space. Such means typically is a planar surface section of a refrigeration unit to which the generator set has been installed.

BRIEF DESCRIPTION OF THE DRAWINGS

This invention may be better understood and its objects and advantages will become apparent to those skilled in the art by reference to the accompanying drawings, in which.

DESCRIPTION OF THE PREFERRED EMBODIMENT

Figure 1:
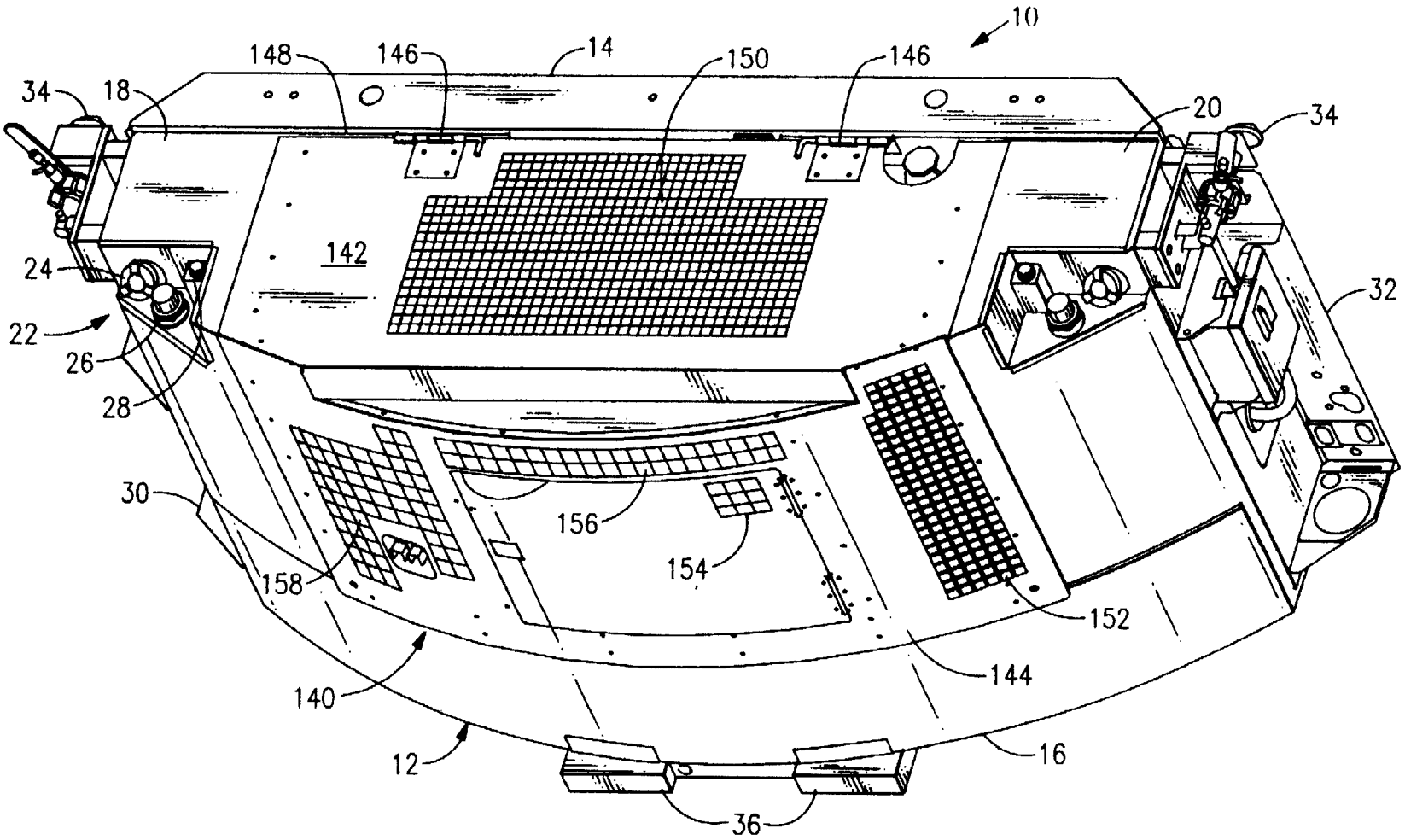
FIG. 1 is a perspective view of a self contained generator set according to the present invention.

FIG. 1 is a perspective view of a diesel driven generator set 10, which is adapted for mounting on the end of a refrigerated container in order to provide electric power to a refrigeration unit which is also mounted on the container. In operation, the generator set 10 provides a constant electrical power supply for operation of the all electric refrigeration unit. A container refrigeration unit adapted for mounting on a refrigerated container, and with which the generator set of the present invention may be used, is manufactured and sold by the Carrier Transicold Division of Carrier Corporation and marketed as Model Series NT.

Figure 2:
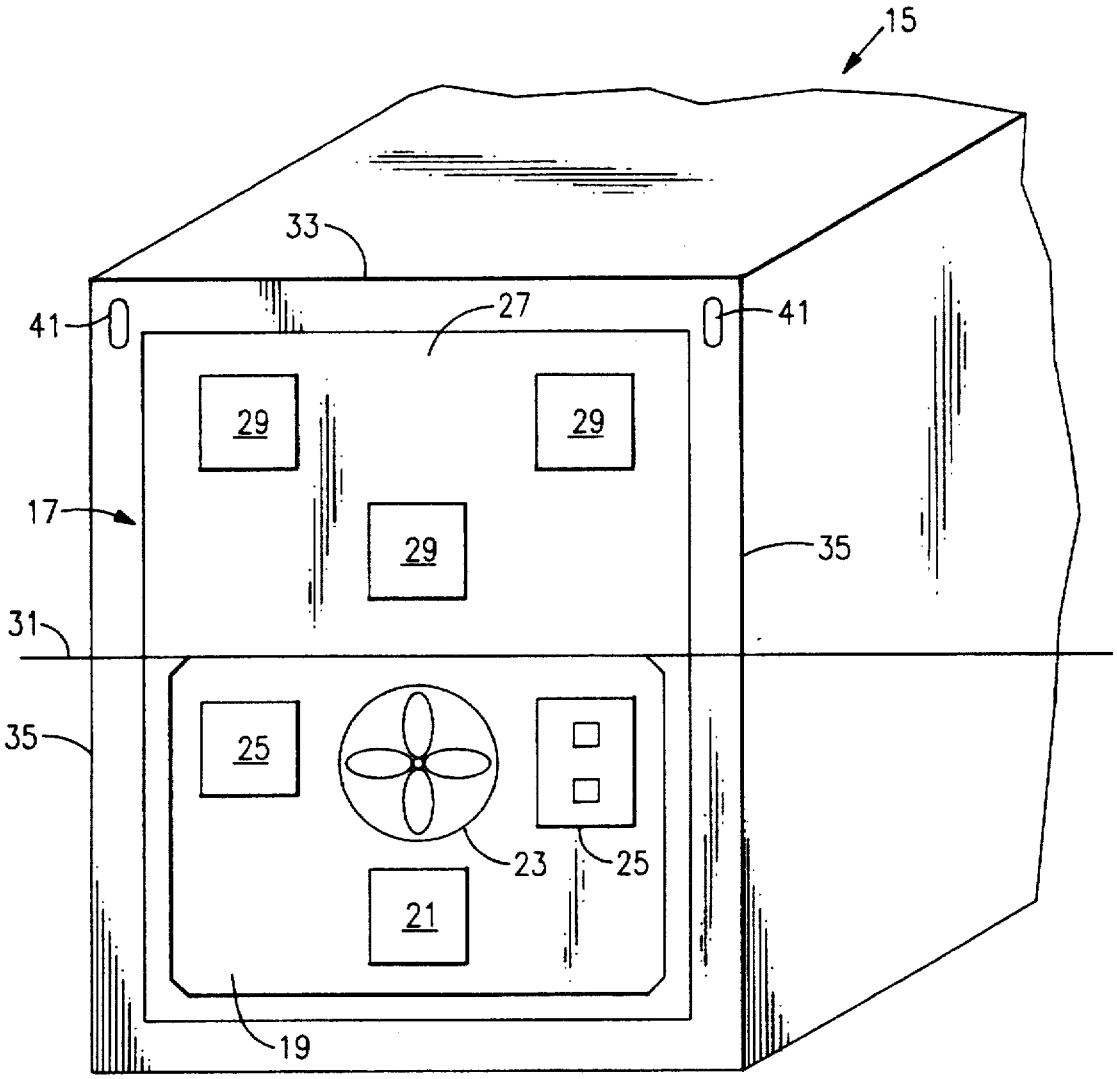
FIG. 2 is a simplified perspective view of a refrigerated container adapted for installation of a generator set according to the present invention.

FIG. 2 schematically illustrates the end of such a refrigerated container 15 having a refrigeration unit 17 such as the aforementioned Carrier Transicold unit mounted thereon. The refrigeration unit is shown schematically and includes a lower "open" section 19, which includes the compressor 21, the condenser fan 23, and controls, generally, 25. An upper section 27 encloses the evaporator fans and other components which are accessible by removal of covers 29. The upper section 27 defines a substantially planar solid surface which a generator set mounted to the unit will be in confronting relation with.

Referring now to FIGS. 1, 3, 4, 5 and 6, the structural framework of the generator set comprises a U-shaped fuel tank generally designated by reference numeral 12 and a number of structural elements, including an angle iron 14, which extends across substantially the entire back of the generator set.

The fuel tank 12, fabricated from structural steel plate, comprises a lower section 16, which extends across substantially the entire bottom of the generator set 10. Extending from the left and fight hand sides of the lower tank 16 are left and right hand tower portions of the fuel tank, 18 and 20, respectively. Each of the towers 18 and 20 is fluidly interconnected with the lower tank section 16. Each of the towers 18 and 20 is provided, at its upper end thereof, with a fuel fill shelf 22, which is provided with an appropriate fuel fill 24, fuel gage 26 and fuel vent 28. The towers 18 and 20 and the upwardly facing planar surface 38 of the lower section 16 cooperate to define a substantially U-shaped structure having a space 44 in which the power generation section 45 of the motor generator set is mounted.

The previously described structural angle 14 is welded to the top of the back side of the fuel towers 18 and 20. Other structural elements include left and right hand vertical extending structural members 30 and 32, respectively, located at the left and right hand ends of the generator set. Preferably, these structural elements 30 and 32 are welded to the left and right hand facing surfaces of the fuel tank towers 18 and 20, respectively. Mounted to the upper end of the structural elements 30 and 32 are suitable clamps 34 well known in the art, which are adapted to structurally attach the generator set 10 to a refrigeration container of the type shown in FIG. 2. Underlying the lower portion 16 of the fuel tank 12 are a pair of structural forklift pockets 36, which form an integral part of the generator set structure and facilitate engagement by a forklift for lifting the unit and positioning it for attachment to a refrigerated container.

Figure 7:
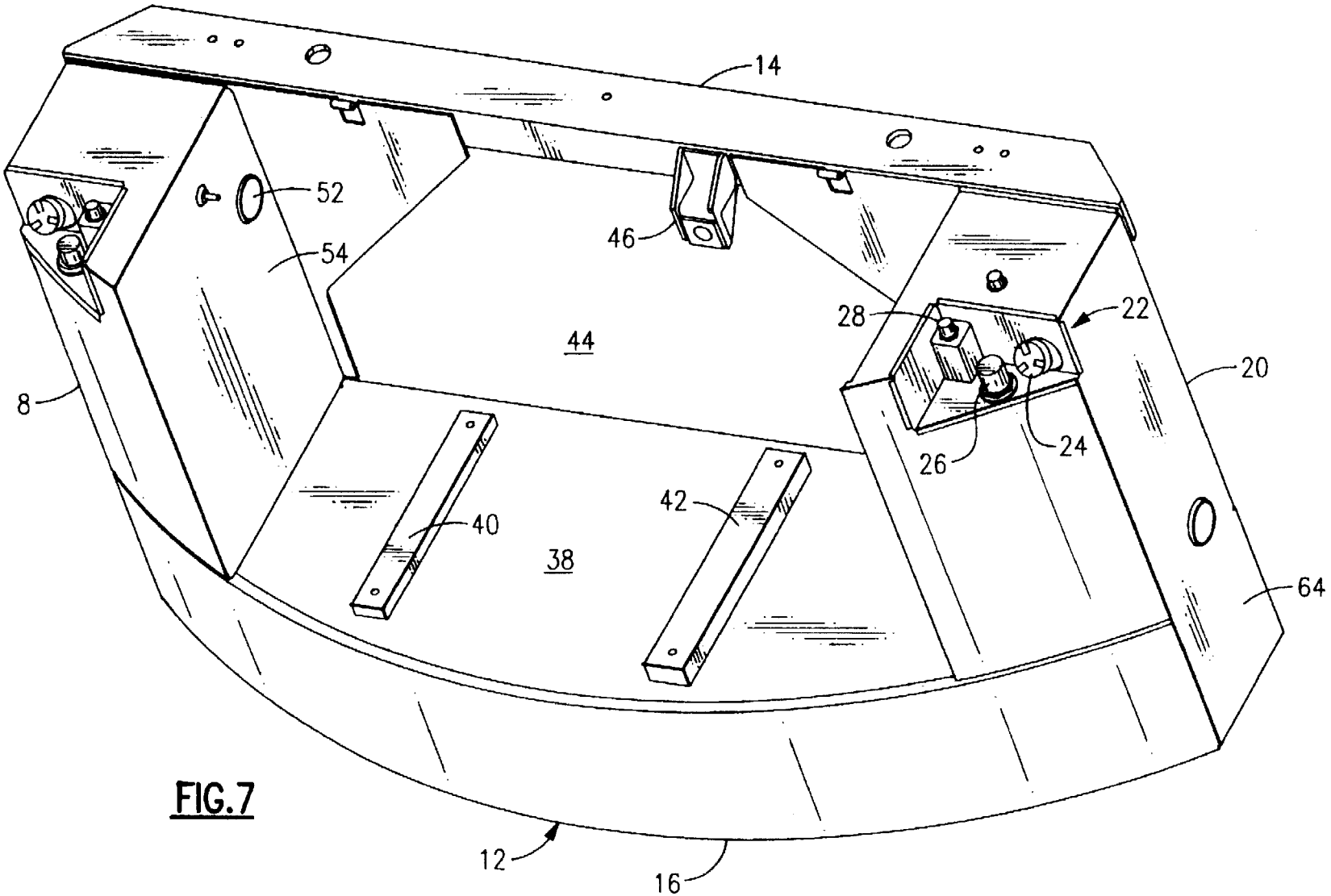
FIG. 7 is a perspective view of the generator set of FIG. 1 with many of the components removed therefrom to show details of the fuel tank.

As best shown in FIG. 7, the upwardly facing planar surface 38 of the lower portion 16 of the fuel tank 12 has a pair of mounting bars 40 and 42 attached thereto. Attached to the angle iron 14 is an angular mounting bracket 46. The mounting bars and the bracket are the attachment points for the motor and generator of the generator set.

Figure 3:
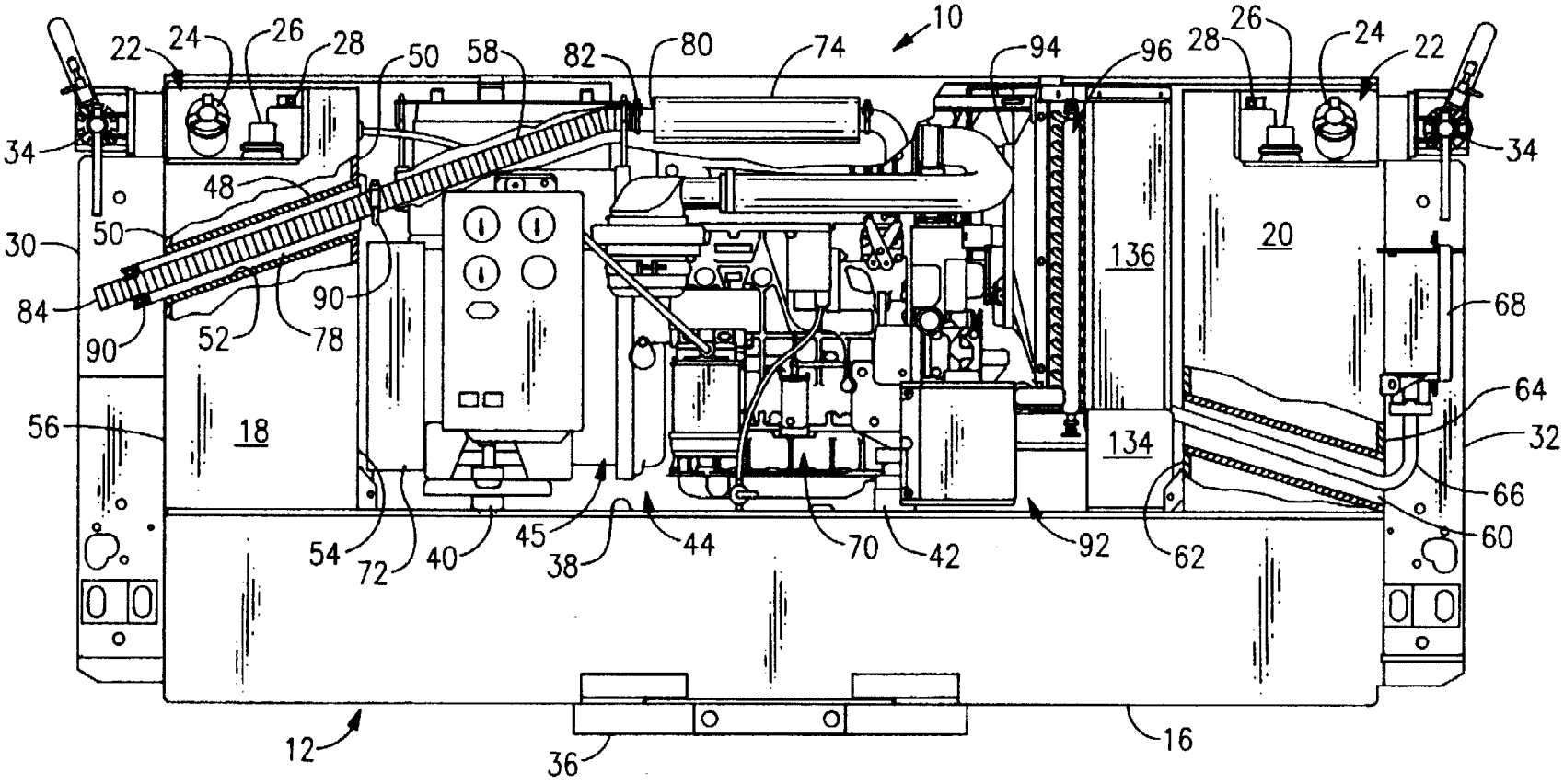
FIG. 3 is a front elevation view of the generator set of FIG. 1 with the cover removed and having sections of the fuel tank partially broken away.
Figure 4:
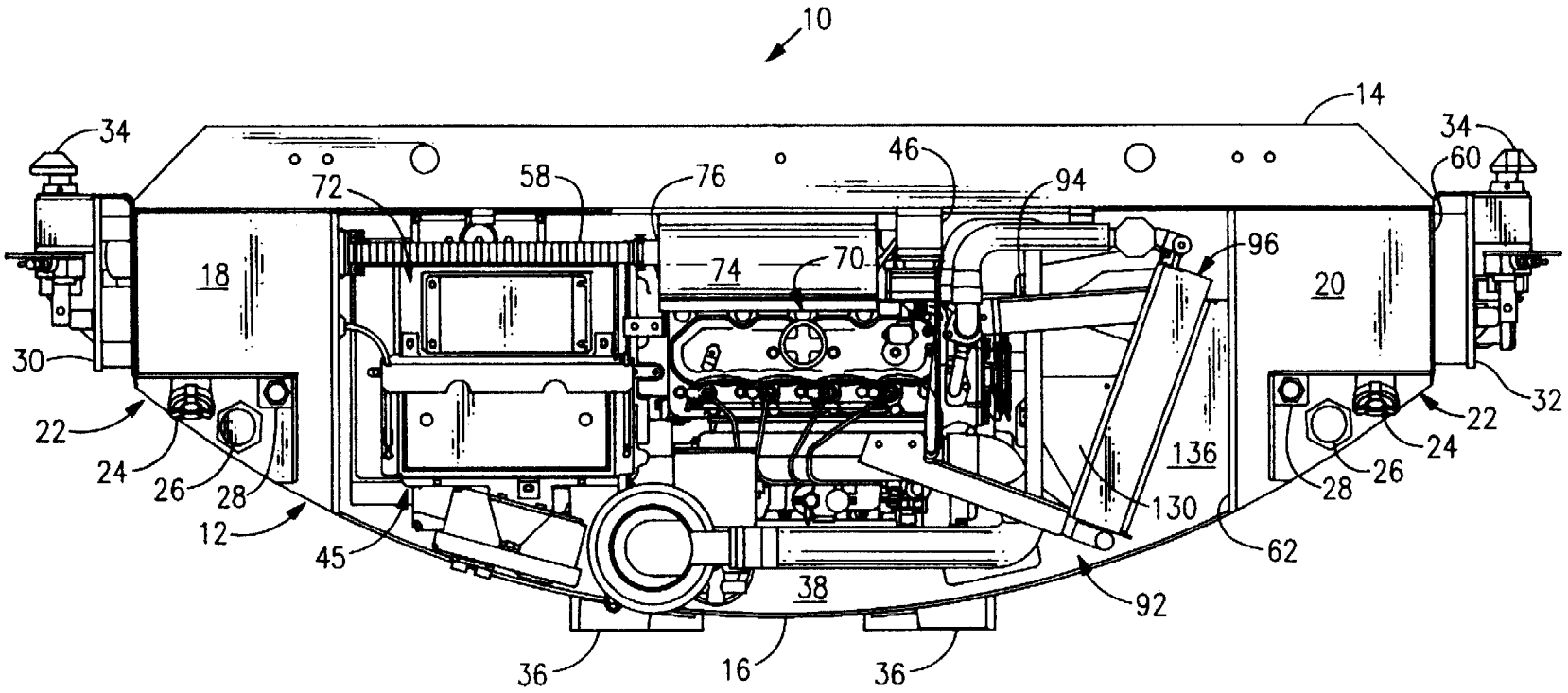
FIG. 4 is a top plan view of the generator set illustrated in FIG. 3.
Figure 5:
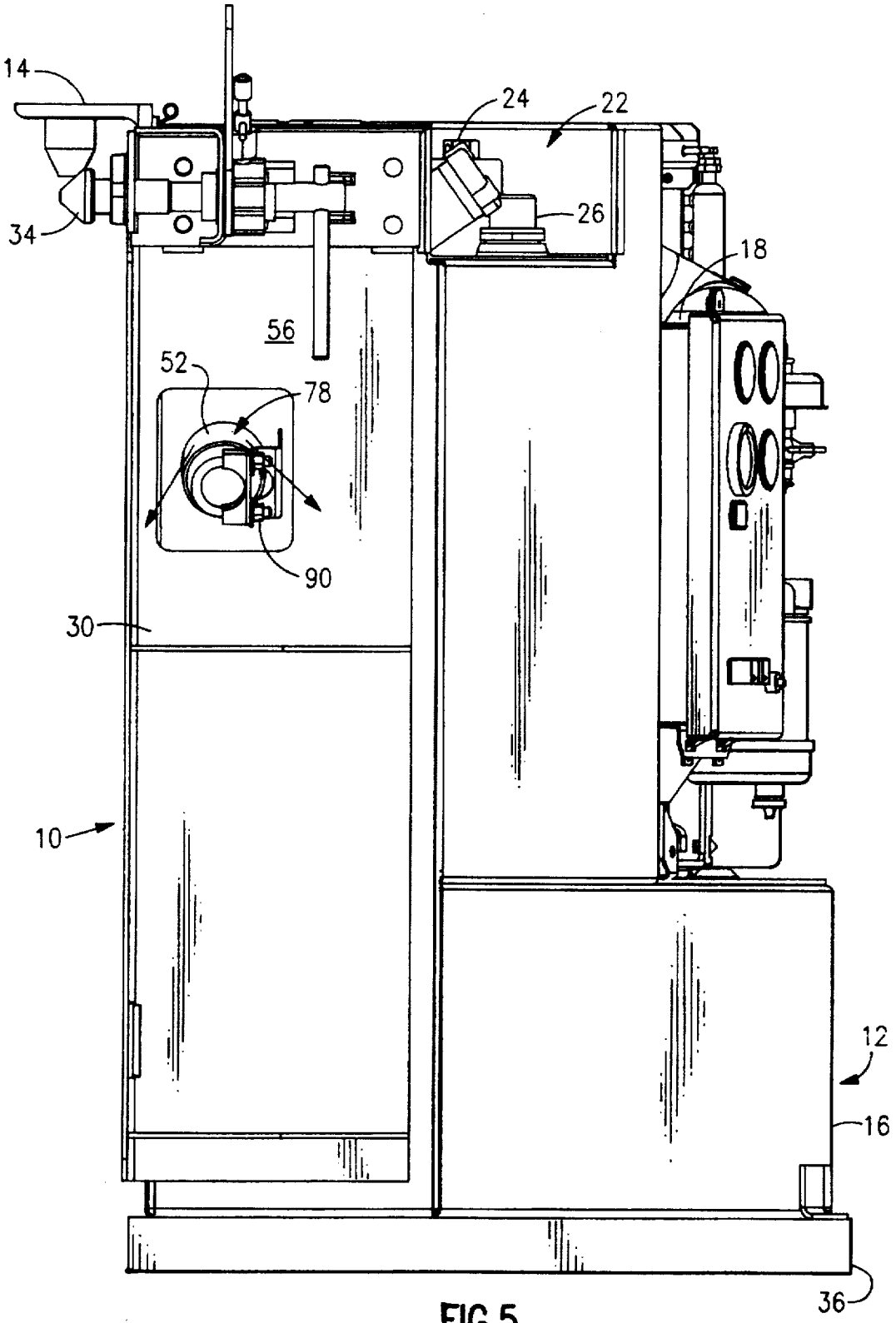
FIG. 5 is a left side view of the unit illustrated in FIG. 3.

As best shown in FIGS. 3, 4 and 5, the left hand fuel tank tower 18 is provided with a circular passage 52 extending from the interior wall 54 thereof to the exterior wall 56. The passage is formed from a steel pipe section 48 integrally welded to openings 50 cut into the walls 54 and 56. As will be described in more detail, the exhaust pipe 58 from the engine of the generator set passes through the passage 52. The passage is inclined downward to facilitate drainage of rainwater or the like from the pipe 48.

Figure 6:
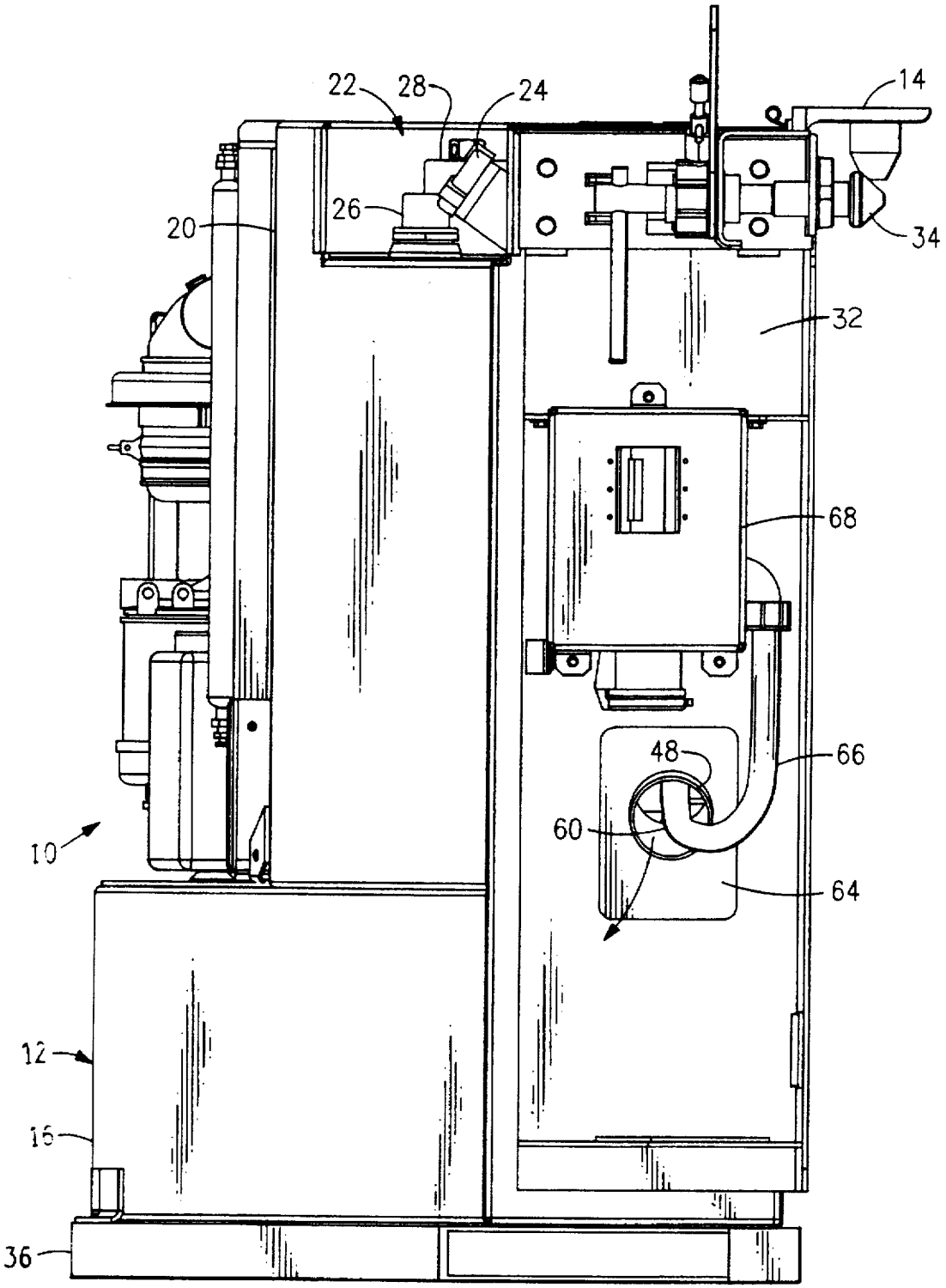
FIG. 6 is a fight side of the unit illustrated in FIG. 3.

In a like manner, the right hand tower 20 of the fuel tank is provided with a passage 60 extending from the interior wall 62 to the exterior wall 64 thereof. This passage 60, as best shown in FIG. 6, is adapted to receive the power cable 66, which interconnects the generator set 10 with a receptacle box 68 mounted on the right hand vertically extending structural member 32.

Looking now at FIGS. 3 and 4, a power generation section 45 includes a diesel engine 70 and a generator 72, which is coupled directly to the engine flywheel. The generator provides a constant 460 vac three phase, 60 hertz electrical supply which is conducted from the generator 72 via power cable 66 which passes directly through passage 60 in the right hand fuel tank tower 20 where it is interconnected as shown in FIG. 4 to a receptacle box 68.

The muffler 74 for the engine is connected to the engine exhaust manifold (not shown) in a conventional manner. The engine exhaust pipe 58 is removably attached to the muffler outlet 80 by a conventional muffler clamp 82. The exhaust pipe 58, as illustrated, is a flexible pipe and passes from the muffler outlet 80 into the passage 52, described above, through the left hand fuel tank tower 18 as is best seen in FIGS. 3 and 5. The exit end 84 of the exhaust pipe 58 extends from the passage 52 to the left of the fuel tank tower 18 to thereby discharge engine exhaust away from the unit. Suitable clamping devices 90 are provided at both the inlet and exit of the passage 52 to secure the exhaust pipe 58. It should be noted that the passage 52 and the exhaust pipe passing therethrough are sized such that the clamps 90 support the pipe in a manner to define a circumferential air space 78 surrounding the exhaust pipe to facilitate cooling of the exhaust pipe and to prevent any undesired overheating of the fuel tank. Specifically, as will be described below, the circumferential air space 78 serves as an outlet for engine cooling air which has been drawn into space 44.

Figure 8:
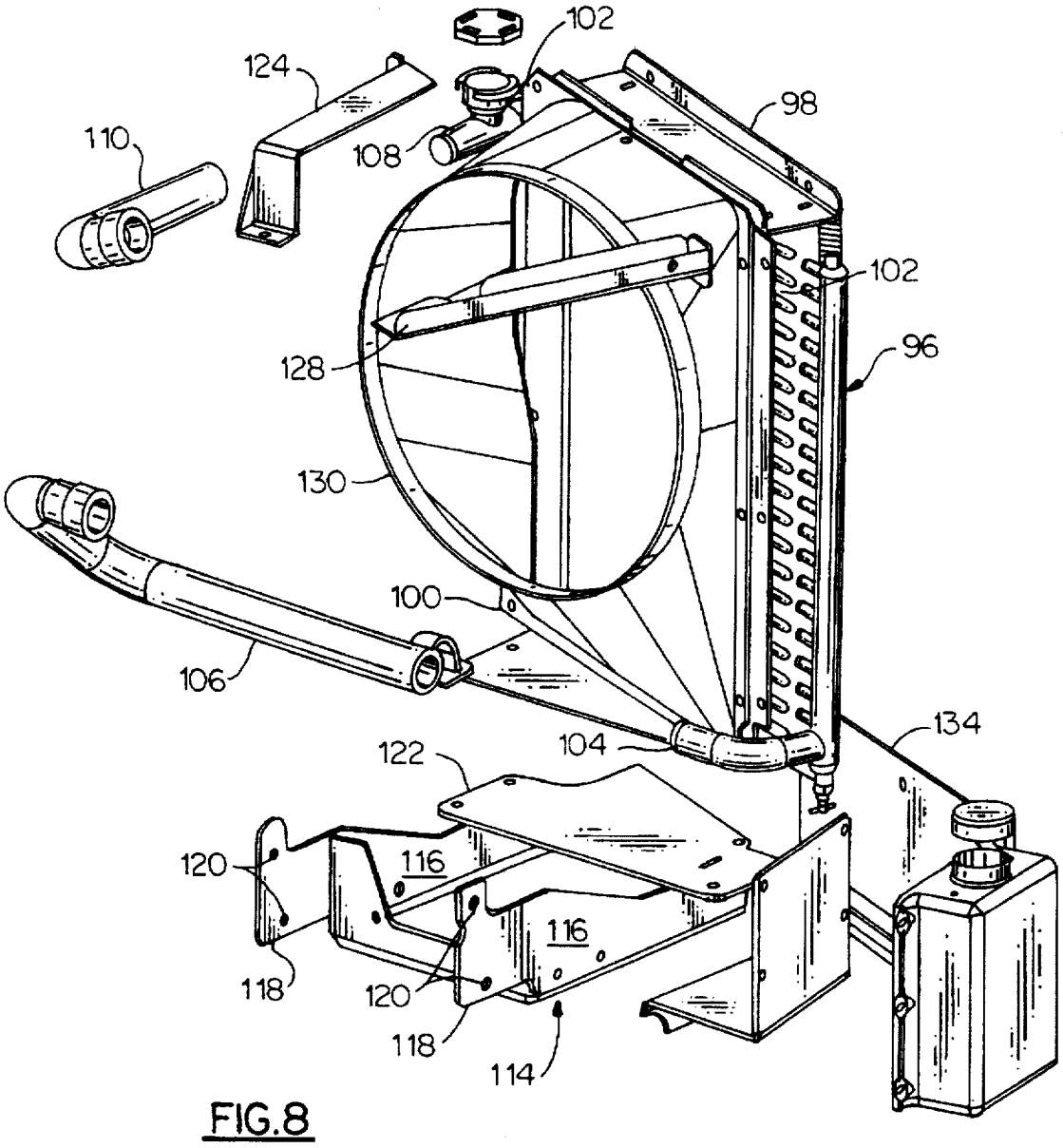
FIG. 8 is an exploded perspective view of the radiator and radiator mounting brackets.

Referring now to FIGS. 3, 4 and 8, the engine 70 is cooled by a radiator system 92 including a fan 94 and a radiator heat exchanger 96. The fan 94 is driven by the engine 70 in a conventional manner. The heat exchanger 96 is of a conventional fin and tube design and includes a structural framework around its periphery as represented by top and bottom mounting channels 98 and 100 and side mounting channels 102. The radiator has a lower hose fitting 104 connected by lower radiator hose 106 to an appropriate coolant connection on the engine, and an upper hose fitting 108 likewise connected by an upper hose 110 to an appropriate fitting on the engine. The radiator fill and cap are located in the upper hose fitting 108.

As is best shown in FIG. 4, the radiator 96 is mounted at an angle to the engine 70. The main radiator mounting bracket 114 comprises a pair of parallel plates 116 having mounting ears 118, which are adapted to be structurally attached to the engine 70 by way of appropriate threaded fasteners through openings 120 provided in the mounting ears 118. The plates 116, in turn support an angularly disposed radiator support plate 122 to which the bottom channel 100 of the radiator is attached. The radiator is further attached to the engine by a first upper support bracket 124 extending from the upper end of the radiator where it is attached to the upper end of one of the side channels 102. A second upper mounting bracket 128 is attached to the side channel 102 on the other side of the radiator, adjacent the upper hose fitting 108, and extends to a suitable structural mounting point on the engine 70.

A formed plastic venturi 130 is attached to the various channels 98, 100 and 102 surrounding the radiator and transitions to a circular cross section, which receives the radiator fan 94. A vertically extending baffle 134 is attached to the bottom mounting channel 100 and extends from the bottom of the radiator downwardly and into contact with the upper surface 38 of the lower section of the fuel tank 16.

As best seen in FIGS. 3 and 4, the radiator 96, the left hand facing wall 62 of the right hand tower 20 of the fuel tank and the support surface 38 of the lower portion of the fuel tank cooperate to define an ambient air flow inlet plenum 136. As will be appreciated following detailed description of the outer cover of the unit, the fan 94 is adapted to draw ambient air from outside the unit into the inlet plenum 136 through the coils of the radiator 96 and the venturi 130 and thence into the interior of space 44.

Figure 1A:
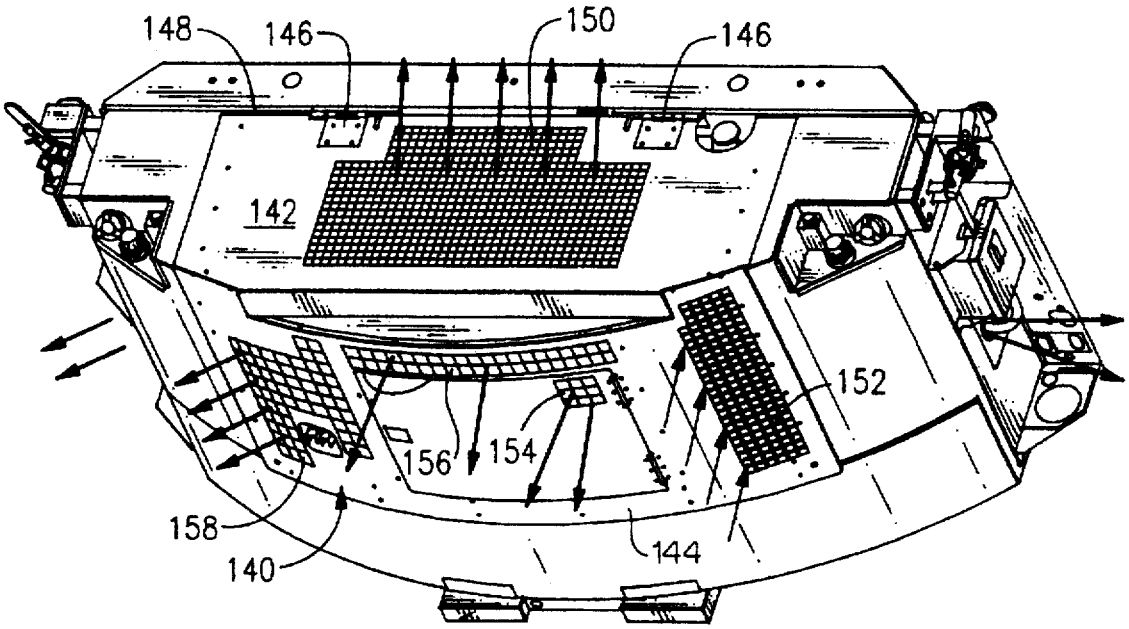
FIG. 1*a* is a view similar to FIG. 1 illustrating air flow when the unit is stationary.
Figure 1B:
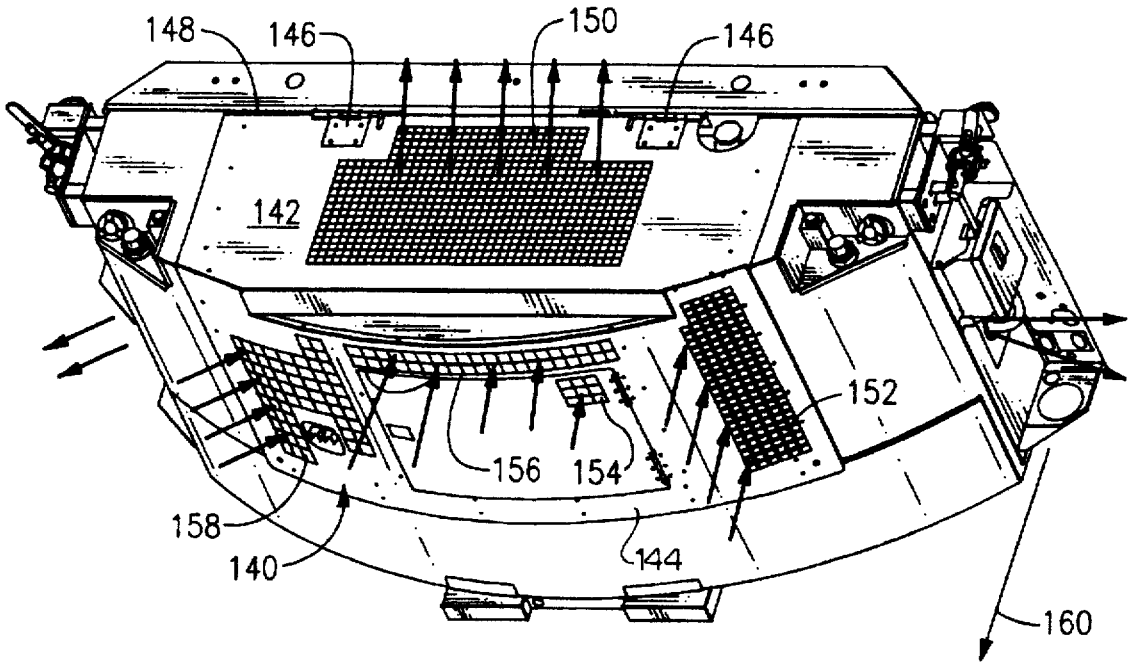
FIG. 1*b* is a view similar to FIG. 1 illustrating air flow when the unit is moving forward.

Looking now at FIGS. 1, 1*a* and 1*b*, it will be noted that space 44 in which the operational components of the generator set 10 are all contained is enclosed by a cover 140. The cover is made preferably from sheet metal and comprises a substantially planar top section 142 and an arcuately shaped front section 144. The cover is provided with a pair of hinges 146 at the back edge 148 of the top 142, which facilitates pivotal movement upwardly and rearwardly to facilitate access to the interior components of the generator set. Suitable conventional mechanical means, such as threaded bolts or the like, are provided to retain the cover in its closed position during normal operation. It should be noted that the hinges may be eliminated and threaded fasteners used for secure attachment of the cover.

Both the top 142 and front 144 of the cover are provided with openings therein to allow the flow of air into and out of the unit in order to facilitate cooling of the engine and the other components thereof. Specifically, the top 142 is provided with a large area 150 of through openings therein illustrated in a grid-like fashion. As will be seen, these openings serve as outlet openings for cooling air escaping from space 44 which is pressurized by inlet air being forced thereinto by the fan 94.

Looking now at the front section 144 of the cover 140, region 152 of inlet openings is located in the front section 144 in direct fluid flow relationship with the inlet plenum 136. Other sets of openings 154, 156 and 158 are provided in the front cover to the left of the inlet plenum region, each of which communicates the interior of space with ambient air. With reference specifically to FIGS. 1*a* and 1*b*, the flow path of cooling ambient air through the generator set 10, when the unit is standing still and when it is traveling forwarding into an air stream will be described. First, it should be noted that in both conditions it is presumed that the unit is mounted on a refrigeration unit, which prevents air flow out the back thereof or that other appropriate means are provided to prevent the flow out of the back of space 44. With reference now to FIG. 1*a*, with the generator set operating, the fan 94 serves to draw ambient air through the openings 152 into the inlet plenum 136 and directs this cooling air over the engine and generator and other internal components thereby pressurizing the interior of space 44.

Under such conditions, the openings 150 in the top, as well as the other sets of openings 154, 156 and 158 in the front serve as outlets from space 44. Also, under these conditions air is forced from the unit through the circumferential space 78 surrounding the exhaust pipe 58 to thereby cool the exhaust pipe and reduce the amount of heat transferred from the exhaust pipe to the fuel tank. In addition, a limited amount of the pressurized air passes from the opening 60 in the right hand tower 20. The flow through this opening is limited as the baffle 134 and other internal barriers limit the flow of air towards this opening.

FIG. 1*b* illustrates the unit moving forward into an air stream as indicated by reference arrow 160. Under such conditions, it will be noted that in addition to the openings 152 drawing ambient air into the inlet plenum the other openings 154, 156 and 158 in the front of the cover also begin operating as cooling air inlets due to of the ram affect of the movement of the unit. Under these conditions all air exits from the interior of space through the openings 150 in the top and through the openings surrounding the exhaust pipe as described above and, to a limited extent, through the opening 60 in the fight hand fuel tank tower.

What is claimed is:

1. A self contained generator set of the type adapted to be mounted on a transport container, which has a refrigeration unit mounted on one end thereof, the generator set providing electrical power for the refrigeration unit, the generator set comprising:

a fuel tank comprising:

a base section defining a substantially horizontal structural support surface, and two vertically extending sections spaced from one another, said support surface and said two vertically extending sections cooperating to define a substantially U-shaped structure having a space therebetween, said space having a substantially open top, front and back;

a power generation section mounted in said space, which comprises an engine having an exhaust pipe, and a radiator assembly for cooling said engine, said radiator assembly including a heat exchanger and a fan, said fan being adapted to draw ambient air from outside said space, and to direct the air across said heat exchanger and into said space;

one of said vertically extending sections of said fuel tank having passageway extending therethrough therein adapted to allow said exhaust pipe to pass therethrough said entrant heat pipe passing through said passageway;

a cover substantially enclosing the front and top of said space, said cover including a front section and a top section, both of said front and top sections having air flow openings therein, some of said openings serving as inlet openings for the flow of ambient air to said radiator fan, other of said openings serving as outlets for air directed into said space, and wherein said passageway through which said exhaust pipe passes serves as an outlet for air directed into said space; and means for preventing air flow through the back of said space.

2. The apparatus of claim 1 including a refrigeration unit which said generator set is in operative relation therewith, and wherein said means for preventing air flow comprises a surface of said refrigeration unit.

3. The apparatus of claim 1 wherein said radiator assembly is positioned in said space adjacent the other of said vertically extending sections of said fuel tank, said other of said vertically extending sections including a substantially planar surface which cooperates with said heat exchanger and said fan to define an ambient air flow inlet plenum.

4. The apparatus of claim 3 wherein a first portion of said openings in said cover serving as inlet openings are located in said front section and extend substantially coextensively with said inlet plenum.

5. The apparatus of claim 4 wherein said openings serving as outlets for air directed into said space are located in said top section of said cover.

6. The apparatus of claim 5 wherein a second portion of openings in said front section of said cover may function as inlet or outlet openings, said second portion serving as inlet openings when said generator set is mounted on a transport container which is moving forward, and serving as outlet openings when said generator set is stationary.

* * * * *